United States Patent [19]

Kamei et al.

[11] Patent Number: 4,504,432

[45] Date of Patent: Mar. 12, 1985

[54] PROCESS FOR PRODUCING A MONOFILAMENT HAVING HIGH TENACITY

[75] Inventors: Ryosuke Kamei, Yokohama; Toyoaki Tanaka; Takeshi Sano, both of Kawasaki; Masataka Kotani, Yokohama, all of Japan

[73] Assignee: Showa Denko Kabushiki Kaisha, Tokyo, Japan

[21] Appl. No.: 572,610

[22] Filed: Jan. 23, 1984

Related U.S. Application Data

[63] Continuation of Ser. No. 444,673, Nov. 26, 1982, abandoned, which is a continuation-in-part of Ser. No. 318,122, Nov. 4, 1981, abandoned.

[30] Foreign Application Priority Data

Sep. 4, 1981 [JP] Japan ..... 56-138316

[51] Int. Cl.[3] ..... D01D 5/12

[52] U.S. Cl. ..... 264/177 F; 264/210.7; 264/210.8

[58] Field of Search ..... 264/177 F, 210.7, 210.8

[56] References Cited

U.S. PATENT DOCUMENTS 3,770,861 11/1973 Hirono et al. ..... 204/210.8

FOREIGN PATENT DOCUMENTS 40-1813 2/1965 Japan ..... 264/290.5

OTHER PUBLICATIONS

"Multistage Stretching of HDPE Monofil in Melt Spinning", Yagi et al., *J. of App. Poly. Sci.*, vol. 22, 2553–2571, (1978).

*Primary Examiner*—James Lowe

*Attorney, Agent, or Firm*—McAulay, Fields, Fisher, Goldstein & Nissen

[57] ABSTRACT

A monofilament of a thermoplastic resin having a high tenacity is produced by a process in which a monofilament is melt spun at a temperature of 220° C. to 310° C. from a thermoplastic resin through a nozzle having a cross-sectional area S ($mm^2$) satisfying the following equations:

$$0.503\ mm^2 \leqq S \leqq 3.14\ mm^2$$

$$0.09 \leqq \frac{I}{S^2} \leqq 0.30$$

wherein I is a maximum cross-sectional secondary moment max (Ix, Iy) (i.e., the maximum secondary moment in the cross-sectional secondary moments with respect to the main x axis and y axis passing through the center of the gravity of the cross-section); and, then, is subjected to a multi-stage stretching under the conditions satisfying the following equations:

$$DR_{Ti} \leqq \frac{V_{i+1}}{V_1} \leqq DR_{Tiw} \times (1.0 - 0.0970e^{-0.312 \times i})$$

$$\theta_i \leqq T_m - 37\ (i = 1)$$

$$T_m - 27 \leqq \theta_i \leqq T_m - 17\ (i \geqq 2)$$

wherein i is a number of stretching stages, e is a base of natural logarithm (i.e., 2.71828), $V_1$ is the first take-off linear velocity (m/min), $V_{i+1}$ is the final take-off linear velocity (m/min) at the i-stretching stage, $DR_{Ti}$ is the total stretching ratio at the i-stretching stage, $DR_{Tiw}$ is the $DR_{Ti}$ from which the monofilament begins to become whitened at the i-stretching stage, $T_m$ is the melting point of the thermoplastic resin and $\theta_i$ is the temperature of the filament at the i-stretching stage.

36 Claims, 8 Drawing Figures

PROCESS FOR PRODUCING A MONOFILAMENT HAVING HIGH TENACITY

CROSS-REFERENCES TO RELATED APPLICATION

This is a continuation of Ser. No. 444,673, filed Nov. 26, 1982, now abandoned, which in turn is a continuation-in-part of Ser. No. 318,122, filed Nov. 4, 1981 and now abandoned.

BACKGROUND OF THE INVENTION (1) Field of the Invention

The present invention relates to a process for producing a monofilament having a high tenacity from a thermoplastic resin, such as polyethylene, polypropylene, polyamide, polyester and the like, by a melt spinning and stretching technique.

(2) Description of the Prior Art

Heretofore, monofilaments obtained from a melt spinning and stretching of thermoplastic resins have been generally produced as follows. For instance, the thermoplastic resin is extruded through nozzles each having a round cross-sectional area, and usually passes through a cooling bath, or is optionally solidified by using a treatment bath to form fibrous materials. The fibrous materials are then stretched or drawn at a low stretching ratio of, for example, 3 through 10 and at an optimum temperature depending upon the type of resin used. Thus, monofilaments having a straight strength of 2 g/d through 7 g/d are produced. In order to increase the tenacity of the monofilaments, the use of a higher stretching ratio of, for example, 11 through 20 is required. However, in this case, although the straight strength is increased, the knot strength is remarkably decreased with the increase in the stretching ratio. Furthermore, in order to increase the stretching ratio, unstretched filaments having a higher denier should be used and, as a result, vacuum bubbles are generated in the filaments due to the deviation of the heat shrinkage at the cooling step in the inner portions of the filaments. The bubbles cause frequent stretching failure. In addition, in the case where filaments are stretched at a higher stretching ratio, other problems including the whitening of the filaments, the generation of fluff and powdering on the surface of the filaments and the like, occur.

Especially, monofilaments made of polyethylene are widely used as fibrous materials for marine industries, since the density of the polyethylene is less than 1. However, the strength of polyethylene is remarkably inferior to those of other synthetic fibrous materials such as polyesters, polyamides and the like. For instance, in the case of ropes, the strength of the ropes made of high-density polyethylene is at most approximately 70% of that of polyester ropes having the same diameter and is at most approximately 50% of that of nylon ropes having the same diameter. For this reason, use of the polyethylene is limited in products, such as towing ropes for large oil tankers, in which high strength is required.

SUMMARY OF THE INVENTION

Accordingly, an object of the present invention is to obviate the above-mentioned problems of the prior arts and to provide a process for producing a monofilament having a high tenacity from thermoplastic resins, in which the problems of the decrease in the knot strength and the stretching failure at a high stretching ratio are effectiveiy solved.

Another object of the present invention is to provide a process for producing a monofilament of thermoplastic resins having a high tenacity of approximately 1.5 through 2.0 times of that of the conventional monofilaments without causing the whitening of the filaments and having a good operating efficiency.

Other objects and advantages of the present invention will be apparent from the following descriptions.

In accordance with the present invention, there is provided a process for producing a monofilament having a high tenacity from a thermoplastic resin, wherein a monofilament is melt spun at a temperature of 220° C. to 310° C. from a thermoplastic resin through a nozzle having a cross-sectional area S ($mm^2$) satisfying the following equations:

$$0.503\ mm^2 \leqq S \leqq 3.14\ mm^2$$

$$0.09 \leqq \frac{I}{S^2} \leqq 0.30$$

wherein I is a maximum cross-sectional secondary moment max (Ix, Iy) (i.e., the maximum secondary moment in the cross-sectional secondary moments with respect to the main x axis and y axis passing through the center of the gravity of the cross-section); and, then, is subjected to multi-stage stretching under the conditions satisfying the following equations.

$$DR_{Ti} = \frac{V_i + 1}{V_1} \leqq DR_{Tiw} \times (1.0 - 0.0970\ e^{-0.312 \times i})$$

$$\theta_1 \leqq T_m - 37 \times (i = 1)$$

$$T_m - 27 \leqq \theta_i \leqq T_m - 17\ (i \geqq 2)$$

wherein i is a number of stretching stages, e is a base of natural logarithm (i.e., 2.71828), $V_1$ is the first take-off linear velocity (m/min), $V_{i+1}$ is the final take-off linear velocity (m/min) at the i-stretching stage, $DR_{Ti}$ is a total stretching ratio at the i-stretching stage, $DR_{Tiw}$ is the $DR_{Ti}$ from which the monofilament begins to become whitened at the i-stretching stage, $T_m$ is the melting point of the thermoplastic resin and $\theta_i$ is the temperature of the filament at the i-stretching stage.

DESCRIPTION OF THE PREFERRED EMBODIMENTS

Figure 1:
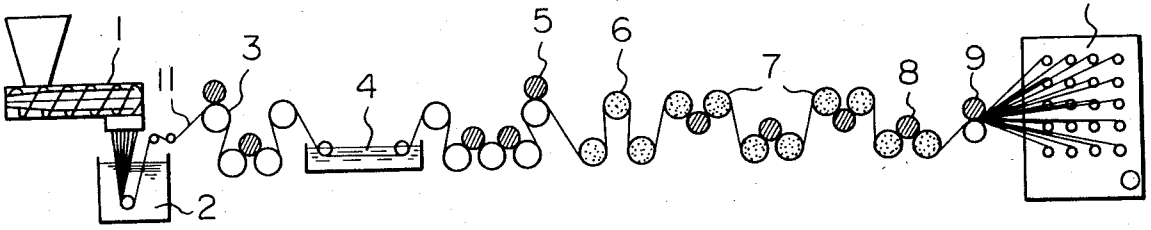
Figure 2A:
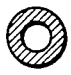
Figure 2B:
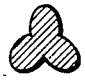
Figure 3A:
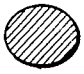
Figure 3B:
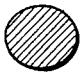
Figure 3C:
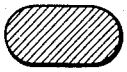
Figure 4:
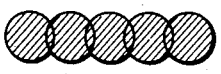
Figure 5:
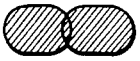

The present invention will now be better understood from the following descriptions presented in connection with the accompanying drawings in which:

FIG. 1 is a schematic drawing illustrating a desirable embodiment of an apparatus in which a monofilament having a high tenacity is produced;

FIG. 2 (*a*) and (*b*) and 3 (*a*), (*b*) and (*c*) are schematic drawings illustrating cross sections of examples of monofilaments of high-density polyethylene obtained from the process of the present invention; and FIGS. 4 and 5 are schematic drawings illustrating cross sections of examples of monofilaments high-density polyethylene having a thick denier obtained from the process of the present invention.

According to the present invention, monofilaments are melt spun at a temperature of 220° C. to 310° C., desirably 250° C. to 310° C., from a thermoplastic resin, such as polyethylene, polypropylene, nylon, polyester or the like, and, then, are stretched in a multi-stage stretching, at a high stretching ratio, without causing the whitening of the filaments and the stretching failure.

The melt spinning temperature of less than 220° C. results in the occurrence of melt fracture and poor stretchability, whereas the melt spinning temperature of more than 310° C. causes deterioration in the properties of the resin and decrease in the properties of the filament.

The optimum stretching ratio at each stretching stage is determined based on the stretching ratio from which the whitening begins and the number of the stretching stages. The optimum filament temperature at each stage is determined based on the melting point of the filaments and the number of the stretching stages.

In the practice of the present invention, $DR_{T1}$ (i.e., the stretching ratio at the first stretching stage) is desirably at least 5, more desirably at least 10. When this ratio is less than 5, the desired complete necking does not occur, filaments having uniform denier cannot be obtained and the desired high tenacity cannot be obtained.

In the case of $DR_{Ti} > DR_{Tiw}$, the problems such as the whitening of the filament, the generation of fluff and powdering on the surface of the filaments occurs, whereby the commercial value is lost. On the other hand, in the case of $DR_{Tiw} > Dr_{Ti} > DR_{Tiw} \times (1.0 - 0.0970e^{-0.312 \times i})$, frequent stretching failure undesirably occurs although no whitening of the filaments is caused. Therefore, according to the present invention, the multi-stage stretching should be carried out under the conditions satisfying the following equations:

$$DR_{Ti} \leqq DR_{Tiw} \times (1.0 - 0.0970^{-0.312 \times i})$$

Furthermore, the temperature $\theta_i$ of the filament should be:

$$\theta_i \leqq T_m - 37 \ (i=1)$$

$$T_m - 27 \leqq \theta_i \leqq T_m - 17 \ (i \geqq 2)$$

In the case where the temperature $\theta_i$ of the filament is not within the above-mentioned range, the whitening phenomenon occurs or the strength is not improved, even if the stretching can be carried out.

In the case where the above-mentioned stretching ratio at each stage and the above-mentioned temperature of the filaments are maintained, filaments having a high tenacity, i.e., more than, 1.5 through 2.0 times that of the conventional filaments, can be effectively produced, without causing the whitening of the filaments.

The monofilaments to be stretched are generally extruded through a screw type extruder. Although any conventional type screw type extruder can be used in the process of the present invention, a screw type extruder having a metering portion of a groove depth Hm of $0.157D^{0.719}$ through $0.269D^{0.719}$ (wherein D is a bore diameter (mm) of the extruder) can be desirably used in the present invention. In the case where the groove depth is less than $0.157D^{0.719}$, the production capacity tends to be decreased and, further, the heat generation of the resin tends to occur, whereby various problems, such as the occurrence of the swing of the filament and smoking during the extrusion and the generation of fluff and powdering, are likely to be caused. Contrary to this, in the case where the groove depth is more than $0.269D^{0.719}$, the discoloration of the filaments and the stretching failure are likely to occur due to the decrease in the mixing of the resin.

The nozzles through which the monofilaments are extruded at a melt spinning step can be those having a cross-sectional area S ($mm^2$) which satisfies the following equation:

$$0.503 \ mm^2 \leqq S \leqq 3.14 \ mm^2$$

$$0.09 \leqq \frac{I}{S^2} \leqq 0.30$$

can be preferably used at the melt spinning step. In the above equation, I represents a maximum cross-sectional secondary moment, max ($I_x$, $I_y$), that is, the maximum secondary moment in the cross-sectional secondary moments with respect to the main x axis and y axis passing through the center of the gravity of the cross-section.

The desirable cross-sectional shapes of the nozzles used in the present invention are those having an oval shape, a capsule shape (or elongated circle shape), a dumb-bell shape and the like and having a cross-sectional area S of 0.503 through 3.14 $mm^2$ and a maximum cross-sectional secondary moment of 0.09 $S^2$ through 0.30 $S^2$ $mm^4$. Especially, the use of the oval shaped nozzle having a ratio of the long axis a to the short axis b (i.e., a/b) of 1.2 through 1.6 is desirable. This is because the manufacture of the nozzles becomes difficult and expensive as the cross-sectional shapes of the nozzles become complicated. The desirable L/De [wherein L: land length (mm), De: perfect circle corresponding diameter (mm)$=2\sqrt{S/\pi}$] of the nozzles is 10 through 15. Although there is no limitation in the structure of the land, the straight type land is desirable in view of the manufacturing cost and the precision of the manufacture (or cutting). The desirable arrangement of the nozzles in the die is such that x or y axis passing through the center of gravity of the cross-section of the nozzles and having a smaller cross-sectional secondary moment is tangential to the pitch circle diameter (P.C.D.). If the nozzles are reversely arranged, the deviation of the heat shrinkage generated in the unstretched filaments cannot be remarkably obviated. By the use of the above-mentioned nozzles, it is difficult for vacuum bubbles to be formed in the unstretched filaments, and even in the case where the filaments are stretched at a high stretching ratio, the undesirable stretching failure does not occur and filaments having a high knot strength can be obtained.

As mentioned hereinabove, the nozzles used in the melt spinning step desirably have a cross-sectional area S of 0.503 through 3.14 $mm^2$ and a maximum cross-sectional secondary moment of 0.09 $S^2$ through 0.30 $S^2$ $mm^4$. In the case where the cross-sectional area S is less than 0.503, the manufacture of the nozzles becomes difficult and, since melt fracture tends to be generated during the melt spinning step, the stretching at a high stretching ratio cannot be effected. On the other hand, in the case where the cross-sectional area is more than 3.14 $mm^2$, the spinning pressure becomes low, so that the discharge becomes uneven and the filaments tend to be cut directly under the nozzle whereby the yield of the filament becomes less. Nozzles having a perfect round or circle cross-sectional shape cannot be used in the practice of the present invention because bubbles are formed in the unstretched filament and, therefore, the desired high stretching ability cannot be obtained.

In the case where the maximum cross-sectional secondary moment i is less than 0.09 $S^2$ $mm^4$ (c.f. in the case of the perfect circles, $$I = \frac{S^2}{4\pi} = 0.0796\ S^2\ mm^4),$$

vacuum bubbles tend to be generated in the unstretched filament and, therefore, the desired high stretching ability cannot be achieved. If the high stretching is carried out, frequent stretching failure is caused and only filaments having a low knot strength can be obtained at a low yield. On the other hand, in the case where the maximum cross-sectional secondary moment I is more than 0.30 $S^2$ $mm^4$, although the above-mentioned problems can be solved, thinner portions are generated in the monofilaments, so that monofilaments tend to be torn off from the thinner portions during the stretching step and, also, the manufacture of, for example, ropes becomes difficult.

In addition, the nozzles used at the melt spinning step in the present invention are desirably such that thermoplastic resins can be melt extruded at a nozzle shear rate of 150 through 900 $sec^{-1}$. In the case where the nozzle shear rate is less than 150 $sec^{-1}$, the spinning pressure is lowered and, therefore, the extrusion rate is varied, whereby products having an uneven denier are produced. Contrary to this, in the case where the nozzle shear rate is more than 900 $sec^{-1}$, the melt fracture tends to be easily generated, and a lot of nozzle dirts tends to be formed at a spinneret during a long period of operation, whereby the filaments tend to be cut under the nozzle.

Furthermore, the stretching ratio f [i.e., $f=V_1/V_0$ wherein $V_0$ is an extrusion linear velocity at a nozzle discharge (m/min.), $V_1$ is a take-off linear velocity (m/sec)] is desirably within the range of 1.00 through 3.50 (usually, 0.5 through 1.5 in the case of a perfect circle) in the present invention. In the case where the stretching ratio is less than 1.0, the desirable increase in the strength of filaments is not obtained due to the insufficient molecule orientation. Contrary to this, in the case where the stretching ratio is more than 3.5, problems, including the stretching failure, the whitening of the stretched filament and the like, tend to occur.

The typical embodiment of the process of the present invention will now be illustrated with reference to the accompanying drawing.

As shown in FIG. 1, a thermoplastic resin is melt extruded at a temperature of 220° C. to 310° C. from a screwtype extruder 1 and, then, passes through a cooling bath, whereby unstretched filaments 11 are produced. The filaments can optionally be solidified by using a treatment bath (not shown in FIG. 1).

The unstretched monofilaments 11 are stretched at a high stretching ratio at an optimum temperature depending upon the type of the thermoplastic resin. For instance, as shown in FIG. 1, the starting monofilaments 11 are first subjected to a first-stage wet stretching in a heated water bath 4 via first take-off rolls 3. Then, the filaments, pass through second take-off rolls 5 and preheating rolls 6, wherein the filaments are preheated to an optimum temperature depending upon the thermoplastic resin used. The filaments thus preheated are subjected to a second stage dry stretching as they pass through the heat rolls 7. The stretched monofilaments are wound through final take-off rolls by using a winder 10, after, optionally, being annealed by means of the annealing heat rolls 9. Although the shapes, arrangements and surface finishing of the rolls used in the process of the present invention are not specifically limited, the use of nip type rolls is desirable, so that the filaments will not slip.

The high stretching ratio can be effected by any known technique, for example, wet type stretching (i.e., stretching in a bath), heat roll type stretching, heat plate type stretching, heated air bath type stretching and the like. These stretching methods can be used alone or in any combination thereof.

As is known in the art, the straight strength of stretched fibrous materials is largely affected by the stretching ratio. Since an extremely high stretching ratio can be effected according to the present invention, filaments having a high tenacity can be produced. In addition, the knot strength of the filaments produced by the present process is higher, by 30 through 50%, than that of the conventional filaments at the same stretching ratio. In addition, according to the present invention, filaments having a high elongation are also produced.

According to another embodiment of the present invention, neck stretching by which necking deformation occurs is desirably effected by a first-stage wet stretching and ultra-stretching after the necking deformation is completed by means of heat rolls. The subsequent multi-stage dry stretching usually means that filaments are stretched in two or more stages. The physical properties, especially the strength, of the filaments are improved with the increase in the number of the stretching stages. However, the installation cost is raised with the increase in the number of the stretching stages. For these reasons, a three or four stage stretching is suitably used from a practical point of view.

As mentioned hereinabove, according to the present invention, the first-stage neck stretching by which necking deformation occurs is desirably effected by wet stretching. Especially, in the case where the stretching by which the necking formation occurs is carried out at a deformation velocity of 50 $min^{-1}$ or less and where the subsequent multi-stage stretching after the completion of the necking deformation is carried out at a deformation velocity of 20 $min^{-1}$ or less, desirable results can be obtained. The deformation velocity at the stretching is defined by $$\frac{V_{i+1} - V_i}{L_i}$$

wherein $L_i$ is an effective stretching distance (m) at the i-stage stretching, $V_i$ is a delivery linear velocity (m/min) of the filament at the i-stretching stage and $V_{i+1}$ is a take-off linear velocity (m/min) of the filament at the i-stretching stage.

If the deformation velocity during the neck stretching is more than 50 $min^{-1}$, problems, including the formation of voids in the filaments, the whitening of the surface of the filaments and the occurrence of the stretching failure, tend to be caused. Contrary to this, if the deformation velocity during the multi-stage stretching after the completion of the necking deformation is more than 20 $min^{-1}$, frequent stretching failure tends to occur and, therefore, sufficient high ratio stretching cannot be effected.

The stretching ratio in each step can be desirably set in such a manner that the stretching ratio is lower, by 0.2 through 0.5 times than that in which the whitening occurs. Furthermore, it is recommended that the neck stretching is effected at a temperature of 100° C. or less and that the subsequent multi-stage stretching after the completion of the necking deformation is effected at a temperature of 100° C. or more.

In the case where the monofilament is produced from polyethylene according to the present invention, polyethylene having a melt index of 0.1 through 0.9 g/10 min can be desirably used. In the case where the melt index of the polyethylene is less than 0.1 g/10 min, problems, including the generation of melt fracture at spinning, is poor stretching property, a decrease in the stretching ratio in which the whitening occurs and a high ratio stretching is impossible, tend to occur and monofilaments having a high tenacity cannot be obtained. On the other hand, in the case where the melt index of the polyethylene is more than 0.9 g/10 min, it is difficult to obtain monofilaments having a high tenacity, although high ratio stretching can be effected.

Furthermore, it is desirable that a ratio of a high-load melt index to a melt index (i.e., high-load melt index/-melt index) of polyethylene is 40 or less. In the case where the ratio of a high-load index is more than 40, not only the desired straight strength and knot strength of the monofilament cannot be obtained, but also the spinnability is decreased, whereby, unless the nozzles having a diameter corresponding to the desired denier are used at the time when the denier of the monofilament is changed, the monofilaments are cut under the nozzles.

Among the polyethylene resins having the above-mentioned melt index and ratio of the high-load melt index to the melt index, medium and high density polyethylene resins can be desirably used in view of the moldability and strength thereof. These resins can be a homopolymer of ethylene and copolymer thereof with other monomer(s). These resins can optionally contain a heat stabilizer, a weathering agent, a lubricant, a matting agent, a pigment, a flame retarder, a foaming agent and the like.

In addition to polyethylene, other thermoplastic resins capable of melt spinning, such as, for example, polyamides, polyesters, polypropylene and the like, can be also used in the production of monofilaments according to the present process.

In the case where a high-density polyethylene having a melt index of 0.1 through 2.0 g/10 min, a density of 0.950 through 0.960 g/cm$^3$ and a HLMI/MI ratio of 20 through 40 is used in the present invention, high-density polyethylene high tenacity monofilaments having the following characteristics can be continuously produced.

Tensile Strength (g/d): 11.0–15.0
Elongation at Break (%): 4.0–10.0
Young's Modulus (kg/mm$^2$): 1600–3200
Melting Point (°C.): 136–145

The denier of the high-density polyethylene filaments produced by the present invention is desirably as thick as 600 denier or more in view of the simplicity of the fabrication. The shapes of the cross-sectional area can be in any shapes. Examples of such shapes are shown in FIGS. 2 through 5. Among these shapes, the filaments having cross-sectional areas of FIGS. 4 and 5, especially FIG. 5 are desirable, since these shapes simplify the subsequent winding and twisting steps of the manufacture of ropes and produce ropes having a high tenacity and a high flexibility.

These high-density polyethylene filaments having a high tenacity can be advantageously used, in lieu of nylon ropes, in the fields of, for example, ropes for large ships (e.g., mooring ropes, tag ropes), since the tensile strength is substantially identical to that of nylon, the density is lower than that of water, the snap back is small and the production cost is less than a half of that of nylon.

As mentioned hereinabove, according to the present invention, the monofilaments having a high tenacity, which is larger, by 50 through 100%, than that of conventional monofilaments can be obtained. Furthermore, in the case where a wet type stretching, the heat transfer coefficient of which is highest, is utilized in the first-stage stretching, the necking point can be fixed and uniform filaments can be obtained. In addition, in the case where heat rolls are utilized in the second and the subsequent stretching steps, the freedom of the selection of numbers of the stretching stages becomes large and, as compared with other technique including hot plate type, heated air type and the like, the installation cost of the apparatus is decreased and the workability is improved.

The present invention now will be further illustrated by, but by no means limited to, the following Examples together with the Comparative Examples.

EXAMPLES 1 TO 4 AND COMPARATIVE EXAMPLES 1 TO 4

High-density polyethylene having a melt index of 0.45 g/10 min and a density of 0.955 g/cm$^3$ was melt extruded and was subjected to a multi-stage stretching, after cooling, under the conditions as shown in Table 1 below. Thus, monofilaments were produced. The results are shown in Table 1.

The common production conditions, other than those shown in Table 1, are as follows.

Extruder: 40 mmϕ, L/D=24
Screw: Compression Ratio of 3.2
Breaker Plate: 2.0 mmϕ×86 H
Screen Pack: Five (80, 100, 120, 150 and 100 meshes)
No. of Nozzle Holes: 40
Extruder Temperature(°C.)*: $C_1$=160, $C_2$=250, $C_3$=290, $D_1$=290, $D_2$=290
Air Gap: 5 cm
Temperature of Cooling Bath: 17° C.
Stretching Temperature:
First Stage; 100° C. (wet type)
Second Stage; 115° C. (Heat Roll type)
Third Stage; 115° C. (Heat Roll type)
Fourth Stage; 120° C. (Heat Roll type)
Test Methods of Physical Properties of Monofilament:
JIS (Japanese Industrial Standards)-L-1070
Chuck Distance=30 cm, Take-off Speed=30 cm/min,
Temperature=20° C., Relative Humidity=60%

* In the case where the same high-density polyethylene as used in these Examples was melt extruded in the same manner except that all extruder temperatures of $C_1$, $C_2$, $C_3$, $D_1$ and $D_2$ were 160° C., vigorous melt fracture occurred in the extrudate and the extrudate was broken after the extruding.

TABLE 1

| | EXAMPLE | | | | COMPARATIVE EXAMPLE | | | |
|---|---|---|---|---|---|---|---|---|
| | 1 | 2 | 3 | 4 | 1 | 2 | 3 | 4 |
| MOLDING CONDITIONS | | | | | | | | |
| Draft Ratio f | 2.16 | 2.58 | 2.59 | 2.75 | 1.36 | 3.49 | 2.80 | 2.21 |
| Cross Sectional Area ($mm^2$) | 2.01 | 1.89 | 2.01 | 2.19 | 0.785 | 2.01 | 2.01 | 1.99 |
| $I/S^2$ | 0.1011 | 0.1036 | 0.2577 | 0.1272 | 0.07958 | 0.07958 | 0.07958 | 0.08649 |
| Shape | Elongated Circle | Oval | Dumb-bell | Oval | Perfect Circle | Perfect Circle | Perfect Circle | Elongated Circle |
| Flatness Ratio a/b | 1.3 | 1.3 | 2.3 | 1.6 | 1.0 | 1.0 | 1.0 | 1.1 |
| First-Stage Stretching Ratio $\alpha^1$ | 13.0 | 13.0 | 13.0 | 13.0 | 10.0 | 10.5 | 10.0 | 13.0 |
| Second-Stage Stretching Ratio $\alpha^2$ | 1.13 | 1.13 | 1.13 | 1.13 | — | — | 1.25 | 1.13 |
| Third-Stage Stretching Ratio $\alpha^3$ | 1.04 | 1.04 | 1.04 | 1.02 | — | — | 1.15 | 1.04 |
| Fourth-Stage Stretching Ratio $\alpha^4$ | — | — | — | 1.13 | — | — | 1.05 | — |
| TOTAL Stretching Ratio $DR_T$ | 15.3 | 15.3 | 15.3 | 16.9 | 10.0 | 10.5 | 15.5 | 15.5 |
| PHYSICAL PROPERTIES | | | | | | | | |
| Denier of Unstretched Filament [De] | 6120 | 5100 | 5100 | 5700 | 4000 | 4200 | 4950 | 6120 |
| Denier of Stretched Filament [De] | 399 | 337 | 340 | 335 | 398 | 395 | 319 | 396 |
| Stretchability (No of Stretching Failure/Times) | No Failure for 6 Hr or more | No Failure for 6 Hr or more | No Failure for 6 Hr or more | No Failure for 6 Hr or more | One/6 Hr | Two/3 Hr | Fif-teen/2 Hr | Five/3 Hr |
| Straight Strength [g/d] | 12.8 | 13.3 | 12.0 | 14.0 | 8.0 | 8.8 | 12.2 | 12.5 |
| Knot Strength [g/d] | 3.6 | 3.9 | 4.0 | 3.7 | 5.7 | 5.3 | 2.7 | 2.8 |
| Straight Elongation [%] | 8.8 | 8.9 | 8.3 | 8.0 | 18.0 | 15.9 | 7.8 | 8.4 |
| Knot Elongation [%] | 2.2 | 2.6 | 2.8 | 2.2 | 9.0 | 7.6 | 1.9 | 2.1 |

As is clear from the results shown in Table 1 above, according to the present invention, the stretchability can be improved and no substantial stretching failure occurs. Furthermore, as to the strength of the monofilaments thus obtained, monofilaments having a high straight strength and high knot strength could be obtained in Examples 1 to 4. Contrary to this, the straight strength was low in Comparative Example 1 probably due to low draft ratio f and low stretching ratio. In Comparative Example 2, the straight strength was also low probably due to the low stretching ratio. In Comparative Example 3, the stretchability was very poor probably due to the low maximum cross-sectional secondary moment, although the draft ratio and the stretching ratios were increased. In Comparative Example 4, the stretchability was also poor due to the low maximum cross-sectional secondary moment.

EXAMPLES 5 TO 7 AND COMPARATIVE EXAMPLES 5 TO 7

High-density polyethylene having a melt index of 0.45 g/10 min and a density of 0.955 g/$cm^3$ was melt extruded and was subjected to a multi-stage stretching, after cooling, under the conditions as shown in Table 2 below. Thus, monofilaments were produced. The results are shown in Table 2.

The common production conditions, other than those shown in Table 2, are as follows.

Extruder: 40 mmϕ, L/D=24
Screw: Compression Ratio of 3.2
Breaker Plate: 2.0 mmϕ×86 H
Screen Pack: Five (80, 100, 120, 150 and 100 meshes)
No. of Nozzle Holes: 40
Extruder Temperature (°C.): $C_1=160$, $C_2=250$, $C_3=290$, $D_1=290$, $D_2=290$
Air Gap: 5 cm
Temperature of Cooling Bath: 17° C.
Test Methods of Physical Properties of Monofilament:
JIS (Japanese Industrial Standards)-L-1070
Chuck Distance=30 cm, Take-off Speed=30 cm/min,
Temperature=20° C., Relative Humidity=60%

TABLE 2

| | EXAMPLE | | | COMPARATIVE EXAMPLE | | |
|---|---|---|---|---|---|---|
| | 5 | 6 | 7 | 5 | 6 | 7 |
| Nozzle | | | | | | |
| Cross Sectional Area ($mm^2$) | 2.01 | 1.89 | 2.01 | 2.01 | 2.01 | 1.99 |
| $\frac{I}{S^2}$ | 0.1011 | 0.1036 | 0.1272 | 0.07958 | 0.07958 | 0.08649 |
| Shape | Elongated Circle | Oval | Oval | Perfect Circle | Perfect Circle | Elongated Circle |
| Flatness Ratio a/b | 1.3 | 1.3 | 1.6 | 1.0 | 1.0 | 1.1 |
| Stretching Ratio | | | | | | |
| $DR_{T1}$ | 13.0 | 13.0 | 13.0 | 10.0 | 13.0 | 13.0 |
| $DR_{T2}$ | 14.7 | 14.7 | 14.7 | 13.0 | 14.7 | 14.7 |
| $DR_{T3}$ | 15.3 | 15.3 | 15.8 | 15.6 | 15.3 | 15.3 |

TABLE 2-continued

| | EXAMPLE | | | COMPARATIVE EXAMPLE | | |
|---|---|---|---|---|---|---|
| | 5 | 6 | 7 | 5 | 6 | 7 |
| Whitening Beginning Stretching Ratio | | | | | | |
| $DR_{T1W}$ | 14.5 | 14.5 | 14.3 | 14.0 | 14.0 | 14.0 |
| $DR_{T2W}$ | 15.7 | 15.7 | 15.5 | 13.5 | 14.7 | 15.5 |
| $DR_{T3W}$ | 16.8 | 16.8 | 16.4 | 14.2 | 14.7 | 16.4 |
| Upper Limit Stretching Ratio* | | | | | | |
| $DR_{T1M}$ | 13.5 | 13.5 | 13.3 | 13.0 | 13.0 | 13.0 |
| $DR_{T2M}$ | 14.9 | 14.9 | 14.7 | 12.8 | 13.9 | 14.7 |
| $DR_{T3M}$ | 16.2 | 16.2 | 15.8 | 13.7 | 14.1 | 15.8 |
| Filament Temperature | | | | | | |
| $\theta_1$ (°C.) | 100 | 100 | 100 | 100 | 100 | 100 |
| $\theta_2$ (°C.) | 115 | 115 | 110 | 115 | 105 | 115 |
| $\theta_3$ (°C.) | 115 | 115 | 120 | 115 | 130 | 130 |
| Stretching Method | | | | | | |
| First Stage Second and Further Stage | wet Heat Roll | wet Heat Roll | wet Heat Roll | wet Heat Roll | wet Heat Roll | wet Heat Roll |
| Denier of Unstretched Filament [De] | 6120 | 5100 | 6320 | 5000 | 5120 | 5120 |
| Denier of Stretched Filament [De] | 399 | 337 | 403 | 320 | 333 | 396 |
| Condition of Filament | Transparent Glossy | Transparent Glossy | Transparent Glossy | Partial Whitening Little Glossy | Whitening Glossy | Transparent Glossy |
| Stretchability No. of Failure/Time | No Failure 6 Hr or more | No Failure 6 Hr or more | No Failure 6 Hr or more | Ten/2 hr | two/3 Hr | Five/3 Hr |
| Straight Strength (g/d) | 12.8 | 13.3 | 13.5 | 12.2 | 11.7 | 12.5 |
| Knot Strength (g/d) | 3.6 | 3.9 | 3.5 | 2.7 | 2.9 | 2.8 |
| Straight Elongation (%) | 8.8 | 8.9 | 7.1 | 7.8 | 7.0 | 8.4 |
| Knot Elongation (%) | 2.2 | 2.6 | 2.0 | 1.9 | 2.7 | 2.1 |

*$DR_{TiM} = DR_{TiW} \times (1.0 - 0.0970e^{-0.312 \times i})$

As is clear from the results shown in Table 2 below, according to the present invention, the monofilaments having a high tenacity could be effectively produced without causing whitening of the monofilaments. Contrary to this, in Comparative Example 5, the stretchability is poor and whitening partially occurred due to $DR_{Ti} > DR_{Tiw} \times (1.0 - 0.0970e^{-0.312 \times i})$. Similarly, in Comparative Example 6, whitening occurred in the products and the strength was somewhat decreased due to the fact that $\theta_i$ did not satisfy the correlation $T_m - 27 \leqq \theta_i \leqq T_m - 17$.

EXAMPLES 8 TO 11

Production of High Tenacity Filament

High-density polyethylene having a melt index of 0.51 g/10 min according to a JIS-K-6760 method and a density of 0.953 g/cm$^3$ was melt extruded under the conditions as shown in Table 3 below and was subjected to a multi-stage stretching after quench. Thus, monofilaments were produced. The results are shown in Table 3 below.

The common production conditions, other than those shown in Table 3, are as follows.

Extruder: 50 mmϕ, L/D=24
Screw: Compression Ratio of 4.0
Breaker Plate: 2.0 mmϕ×130 H
Screen Pack: Five (80, 100, 120, 150 and 100 meshes)
No. of Nozzle Hole: 60
Extruder Temperature(°C.): $C_1=160$, $C_2=250$, $C_3=290$, $D_1=290$, $D_2=290$
Air Gap: 5 cm
Temperature of Cooling Bath(°C.): 15° C.
Stretching Temperature:
First Stage; 100° C. (Wet type)
Second Stage; 115° C. (Heat Roll)
Third Stage; 115° C. (Heat Roll)
Fourth Stage; 140° C. (Heat Roll)
Production Rate: 16 Kg/Hr

Manufacture of Rope

Rope having a thickness of 12 mm was prepared, according to a JIS-L-2705 method, by using the high tenacity polyethylene monofilaments produced above. The results are shown in Table 4 below.

Test Methods of Samples

The physical properties of the monofilaments were determined according to JIS-L-1070 and 1073 methods, wherein a chuck distance of 30 cm, a take-off speed of 30 cm/min, a temperature of 20° C. and a relative humidity of 60% were used.

The physical properties of the ropes were determined according to JIS-L-2704, 2705 and 2706 methods, wherein a temperature of 20±2° C. and a relative humidity of 65±2% were used.

COMPARATIVE EXAMPLES 8 TO 10

The physical properties of commercially available polyethylene filaments, polypropylene multi-filaments and nylon multi-filaments and ropes having a thickness of 12 mm comprised by each filament were determined in a manner as described in Examples 8 to 11. The results are shown in Tables 3 and 4.

TABLE 3

| Samples | EXAMPLE 8 High Density Polyethylene Having High Tenacity | 9 | 10 | 11 | COMPARATIVE EXAMPLE 8 Commercially Available Polyethylene Filament | 9 Commercially Available Polypropylene Filament | 10 Commercially Available Nylon Filament |
|---|---|---|---|---|---|---|---|
| Molding Condition | | | | | | | |
| Cross-Sectional Area S ($mm^2$) of Nozzle | 2.01 | 2.01 | 2.19 | 2.01 | — | — | — |
| $I/S^2$ | | | | | — | — | — |
| First Stretching Ratio | 13.0 | 13.0 | 12.3 | 12.3 | — | — | — |
| Second Stretching Ratio | 1.13 | 1.13 | 1.08 | 1.08 | — | — | — |
| Third Stretching Ratio | 1.04 | 1.04 | 1.04 | 1.04 | — | — | — |
| Fourth Stretching Ratio | — | 1.15 | 1.04 | 1.16 | — | — | — |
| Total Stretching Ratio | 15.3 | 17.6 | 14.3 | 16.0 | — | — | — |
| Physical Properties of Filament | | | | | | | |
| Cross-Sectional Shape of Filament | Approximately Circle | Flat Circle | Flat Circle | Five Parallel Filament of Flat Circle | Approximately Circle | Multi-Filament | Multi-Filament |
| Denier of Filament [De] | 400 | 300 | 400 | 2000 | 400 | 680 | 1260 |
| Tensile Strength (g/d) | 12.4 | 15.0 | 12.8 | 12.2 | 8.0 | 7.5 | 8.0 |
| Knot Strength (g/d) | 3.59 | 3.26 | 3.69 | 2.53 | 4.45 | 5.00 | 5.53 |
| Elongation at Break (%) | 7.4 | 7.0 | 10.0 | 4.2 | 12.6 | 20.0 | 18.2 |
| Young's Modulus ($kg/mm^2$) | 1950 | 2800 | 1600 | 1900 | 780 | 580 | 360 |
| Melting Point (°C.) | 140 | 141 | 139 | 138 | 134 | 170 | 218 |

TABLE 4

| Rope Having 12 mm Diameter | EXAMPLE 8 | 9 | 10 | 11 | COMPARATIVE EXAMPLE 8 | 9 | 10 |
|---|---|---|---|---|---|---|---|
| Physical Properties of Rope | | | | | | | |
| Height kg/200 m | 13.5 | 15.6 | 14.8 | 14.5 | 14.5 | 14.3 | 18.2 |
| Breaking Power (t) | 2.53 | 3.12 | 2.66 | 2.80 | 1.43 | 1.70 | 2.83 |
| Elongation at Break (%) | 26.0 | 17.0 | 21.0 | 15.0 | 32.0 | 38.7 | 53.0 |
| Strength per Unit Weight (kg m/g) | 37.4 | 40.0 | 36.0 | 38.5 | 19.7 | 23.8 | 31.1 |
| Gloss and Color | Good | Good | Good | Good | Good | Good | Good |
| Flexibilty | Fairly Good | Very Good | Very Good | Fairly Good | Fairly Good | Good | Very Good |
| Snap Back | Very Small | Very Small | Very Small | Very Small | Small | Fairly Large | Very Large |
| in Water | Float | Float | Float | Float | Float | Float | Sink |
| Relative Filament Cost per Unit Strength | 110 | 105 | 114 | 100 | 167 | 173 | 264 |

EXAMPLES 12 TO 14 AND COMPARATIVE EXAMPLES 11 TO 17

High density polyethylene containing 0.5% of zinc stearate, 0.1% of 2,6-di-tert butyl-4-methylphenol, 0.1% of calcium stearate, 0.05% of dimyristylthiodipropionate was melt extruded and stretched, after water cooling, in the conditions as shown in Table 5 below. Thus, monofilaments were produced. The results are shown in Table 5 below.

The common production conditions, other than those shown in Table 5, are as follows.

Extruder: 40 mmϕ, L/D=24
Screw: Compression Ratio of 3.2
Breaker Plate: 2.0 mmϕ×86 H
Screen Pack: Five (80, 100, 120, 150 and 100 meshes)
No. of Nozzle Holes: 40
Extruder Temperature(°C.): $C_1$=160, $C_2$=250, $C_3$=290, $D_1$=290, $D_2$=290
Air Gap: 5 cm
Spinning Speed (High Speed Side): 110 m/min.
Temperature of Cooling Bath: 17° C.
Stretching Temperature:
First Stage; 100° C. (Wet type)
Second Stage; 115° C. (Heat Roll type)
Third Stage; 115° C. (Heat Roll type)
Fourth Stage; 120° C. (Heat Roll type)
Test Methods of Physical Properties of Monofilament:
JIS (Japanese Industrial Standards)-L-1070 and 1073
Chuck Distance=30 cm, Take-off Speed=30 cm/min.
Temperature=20° C., Relative Humidity=60%

TABLE 5

| | EXAMPLE 12 | 13 | 14 | COMPARATIVE EXAMPLE 11 | 12 | 13 | 14 | 15 | 16 | 17 |
|---|---|---|---|---|---|---|---|---|---|---|
| Resin | | | | | | | | | | |
| Polyethylene Density ($g/cm^3$) | 0.954 | 0.948 | 0.953 | 0.964 | 0.945 | 0.954 | 0.953 | 0.953 | 0.953 | 0.953 |
| M.I. (g/10 min) | 0.83 | 0.2 | 0.60 | 0.35 | 0.02 | 1.5 | 0.51 | 0.35 | 0.35 | 0.35 |
| H.L.M.I/M.I. | 36 | 35 | 24 | 57 | 43 | 38 | 32 | 45 | 45 | 45 |
| Extrusion | | | | | | | | | | |
| Groove Depth of Metering Zone (mm) | 3.0 | 3.6 | 3.0 | 2.4 | 3.6 | 2.0 | 2.4 | 1.7 | 2.4 | 2.4 |
| Nozzle Shear Rate ($sec^{-1}$) *1 | 400 | 320 | 590 | 590 | 400 | 320 | 1250 | 590 | 590 | 590 |

TABLE 5-continued

| | | EXAMPLE | | | COMPARATIVE EXAMPLE | | | | | | |
|---|---|---|---|---|---|---|---|---|---|---|---|
| | | 12 | 13 | 14 | 11 | 12 | 13 | 14 | 15 | 16 | 17 |
| Surface Roughing Degree *2 | | 1 | 1 | 1 | 1 | 3 | 1 | 4 | 1 | 1 | [illegible] |
| No. of Filaments Cut under Nozzle. *3 | | 0 | 0 | 0 | 2 | 4 | 0 | 10 | 12 | 0 | [illegible] |
| Cross-Sectional Area S ($mm^2$) | | | | | | | | | | | |
| $I/S^2$ | | | | | | | | | | | |
| Stretching | | | | | | | | | | | |
| Stretching | First Stage | 40.0 | 28.1 | 40.0 | 30.0 | 40.0 | 28.1 | 40.0 | 40.0 | 72.0 | 40.0 |
| Deformation | Second Stage | 12.0 | 6.9 | 12.0 | — | 12.0 | 6.9 | 12.0 | 12.0 | — | 2.0 |
| Velocity | Third Stage | 4.2 | 3.5 | 4.2 | — | 4.2 | 3.5 | 4.2 | 4.2 | — | 4.2 |
| ($min^{-1}$) | Fourth Stage | — | 15.6 | — | — | — | 15.6 | — | — | — | — |
| Stretching | First Stage | 100 | 100 | 100 | 100 | 100 | 100 | 100 | 100 | 100 | 90 |
| Temp. (°C.) | Second Stage | 115 | 115 | 115 | — | 115 | 115 | 115 | 115 | — | 98 |
| | Third Stage | 115 | 115 | 115 | — | 115 | 115 | 115 | 115 | — | 98 |
| | Fourth Stage | — | 140 | — | — | — | 140 | — | — | — | — |
| Stretching Ratio | | 15.3 | 16.0 | 15.3 | 13.0 | 15.3 | 16.0 | 15.3 | 15.3 | 13.0 | 15.3 |
| Stretchability *4 | | 0 | 0 | 0 | 1 | 15 | 2 | 5 | 20 | 5 | [illegible] |
| Physical Properties of Filament | | | | | | | | | | | |
| Straight Strength (g/d) | | 12.0 | 15.0 | 14.5 | 9.9 | Stretch- | 10.5 | 12.2 | Stretching | 9.9 | 10.4 |
| Knot Strength (g/d) | | 4.5 | 3.4 | 4.0 | 3.2 | ing | 3.7 | 2.7 | impossible | 3.0 | 1.7 |
| Straight Elongation (%) | | 9.2 | 7.0 | 8.0 | 10.9 | Im- | 7.0 | 7.8 | | 11.2 | 9.5 |
| Knot Elongation (%) | | 2.9 | 2.3 | 2.5 | 3.9 | possible | 1.8 | 1.9 | | 3.5 | 2.0 |

*1 Nozzle Shear Rate $$\gamma = \frac{4Q}{\pi R^3}$$

Q: Extrusion Volume ($cm^3$/sec)
R: Nozzle Relative Radius (cm)
*2 Surface Roughening Degree was visually observed according to the following standards.
1: Very Good
2: Good
3: Stretching Possible Limit
4: Surface Roughening
5: Extremely Surface Roughening
*3 No. of filaments cut under the nozzles during 1.5 hours' spinning operation was counted.
*4 No. of filaments cut during 1.5 hours' stretching operation was counted.

We claim:

1. A process for producing a monofilament having a high tenacity from a thermoplastic resin, wherein a monofilament is melt spun at a temperature of 220° C. to 310° C. from a thermoplastic resin through a nozzle having a cross-sectional area S ($mm^2$) satisfying the following equations:

$$0.503\ mm^2 \leqq S \leqq 3.14\ mm^2$$

$$0.09 \leqq \frac{I}{S^2} \leqq 0.30$$

wherein I is a maximum cross-sectional secondary moment max (Ix, Iy) (i.e., the maximum secondary moment in the cross-sectional secondary moments with respect to the main x axis and y axis passing through the center of the gravity of the cross-section); and, then, is subjected to multi-stage stretching under the conditions satisfying the following equations:

$$DR_{Ti} = \frac{V_{i+1}}{V_1} \leqq DR_{Tiw} \times (1.0 - 0.0970e^{-0.312 \times i})$$

$$\theta_i \leqq T_m - 37\ (i = 1)$$

$$T_m - 27 \leqq \theta_i \leqq T_m - 17\ (i \geqq 2)$$

wherein i is a number of stretching stages, e is a base of natural logarithm (i.e., 2.71828), $V_1$ is the first take-off linear velocity (m/min), $V_{i+1}$ is the final take-off linear velocity (m/min) at the i-stretching stage, $DR_{Ti}$ is the total stretching ratio at the i-stretching stage, $DR_{Tiw}$ is the $DR_{Ti}$ from which the monofilament begins to become whitened at the i-stretching stage, $T_m$ is the melting point of the thermoplastic resin and $\theta_i$ is the temperature of the filament at the i-stretching stage.

2. A process as claimed in claim 1, wherein a neck stretching by which necking deformation occurs is effected during first-stage wet stretching and subsequent-stage dry stretching is effected by means of heated rolls after the completion of the necking deformation.

3. A process as claimed in claim 1 or 2, wherein polyethylene having a melt index of 0.1 through 0.9 g/10 min. and a ratio of a high-load melt index to a melt index of 40 or less is used.

4. A process as claimed in claim 1 or 2, wherein the extrusion of the monofilament is effected through a screw type extruder having a metering portion having a groove depth Hm of $0.157D^{0.719}$ through $0.269D^{0.719}$ mm, wherein D is a bore diameter (mm) of the extruder.

5. A process as claimed in claim 4, wherein polyethylene having a melt index of 0.1 through 0.9 g/10 min and a ratio of a high-load melt index to a melt index of 40 or less is melt extruded at a nozzle shear rate of 150 through 900 $sec^{-1}$ and the extruded monofilament is stretched.

6. A process as claimed in claim 5 wherein the first-stage neck stretching by which necking deformation occurs is effected at a deformation velocity of 50 $min^{-1}$ or less and subsequent-stage stretching is effected at a deformation velocity of 20 $min^{-1}$ or less $$\frac{V_{i+1} - V_i}{L_i}$$

wherein $L_i$ is an effective stretching distance (m) at the i-stage stretching, $V_i$ is a delivery linear velocity (m/min) of the filament at the i-stretching stage and $V_{i+1}$ is the final take-off linear velocity (m/min) of the filament at the i-stretching stage.

7. A process as claimed in claim 6 wherein the first-stage neck stretching is effected at a temperature of 100°

C. or less and the subsequent-stage stretching after the completion of the neck stretching is effected at a temperature of 100° C. or more.

8. A process as claimed in claim 2, wherein polyethylene having a melt index of 0.1 through 0.9 g/10 min. and a ratio of a high-load melt index to a melt index of 40 or less is used.

9. A process as claimed in claim 2, wherein the extrusion of the monofilament is effected thorugh a screw type extruder having a metering portion having a groove depth Hm of $0.157D^{0.719}$ through $0.269D^{0.719}$ mm, wherein D is a bore diameter (mm) of the extruder.

10. A process as claimed in claim 9, wherein polyethylene having a melt index of 0.1 through 0.9 g/10 min and a ratio of a high-load melt index to a melt index of 40 or less is melt extruded at a nozzle shear rate of 150 through 900 $sec^{-1}$ and the extruded monofilament is stretched.

11. A process as claimed in claim 10, wherein the first-stage neck stretching by which necking deformation occurs is effected at a deformation velocity of 50 $min^{-1}$ or less and subsequent-stage stretching is effected at a deformation velocity of 20 $min^{-1}$ or less $$\frac{V_{i+1} - V_i}{L_i}$$

wherein $L_i$ is an effective stretching distance (m) at the i-stage stretching, $V_i$ is a delivery linear velocity (m/min) of the filament at the i-stretching stage and $V_{i+1}$ is the final take-off linear velocity (m/min) of the filament at the i-stretching stage.

12. A process as claimed in claim 11, wherein the first-stage neck stretching is effected at a temperature of 100° C. or less and the subsequent-stage stretching after the completion of the neck stretching is effected at a temperature of 100° C. or more.

13. A process as claimed in claim 3, wherein the extrusion of the monofilament is effected through a screw type extruder having a metering portion having a groove depth Hm of $0.157D^{0.719}$ through $0.269D^{0.719}$ mm, wherein D is a bore diameter (mm) of the extruder.

14. A process as claimed in claim 13, wherein polyethylene having a melt index of 0.1 through 0.9 g/10 min and a ratio of a high-load melt index to a melt index of 40 or less is melt extruded at a nozzle shear rate of 150 through 900 $sec^{-1}$ and the extruded monofilament is stretched.

15. A process as claimed in claim 14, wherein the first-stage neck stretching by which necking deformation occurs is effected a a deformation velocity of 50 $min^{-1}$ or less and subsequent-stage stretching is effected at a deformation velocity of 20 $min^{-1}$ or less $$\frac{V_{i+1} - V_i}{L_i}$$

wherein $L_i$ is an effective stretching distance (m) at the i-stage stretching, $V_i$ is a delivery linear velocity (m/min) of the filament at the i-stretching stage and $V_{i+1}$ is the final take-off linear velocity (m/min) of the filament at the i-stretching stage.

16. A process as claimed in claim 15, wherein the first-stage neck stretching is effected at a temperature of 100° C. or less and the subsequent-stage stretching after the completion of the neck stretching is effected at a temperature of 100° C. or more.

17. A process as claimed in claim 2, wherein polyethylene having a melt index of 01. through 0.9 g/10 min and a ratio of a high-load melt index to a melt index of 40 or less is melt extruded at a nozzle shear rate of 150 through 900 $sec^{-1}$ and the extruded monofilament is stretched.

18. A process as claimed in claim 17, wherein the first-stage neck stretching by which necking deformation occurs is effected at a deformation velocity of 50 $min^{-1}$ or less and subsequent-stage stretching is effected at a deformation velocity of 20 $min^{-1}$ or less $$\frac{V_{i+1} - V_i}{L_i}$$

wherein $L_i$ is an effective stretching distance (m) at the i-stage stretching, $V_i$ is a delivery linear velocity (m/min) of the filament at the i-stretching stage and $V_{i+1}$ is the final take-off linear velocity (m/min) of the filament at the i-stretching stage.

19. A process as claimed in claim 18, wherein the first-stage neck stretching is effected at a temperature of 100° C. or less and the subsequent-stage stretching after the completion of the neck stretching is effected at a temperature of 100° C. or more.

20. A process as claimed in claim 1, wherein polyethylene having a melt index of 0.1 through 0.9 g/10 min and a ratio of a high-load melt index to a melt index of 40 or less is melt extruded at a nozzle shear rate of 150 through 900 $sec^{-1}$ and the extruded monofilament is stretched.

21. A process for producing a monofilament having a high tenacity from a thermoplastic resin, wherein a monofilament is melt spun at a temperature of 220° C. to 310° C. from a thermoplastic resin through a nozzle having a cross-sectional area S ($mm^2$) satisfying the following equations:

$$0.503\ mm^2 \leqq S \leqq 3.14\ mm^2$$

$$0.09 \leqq \frac{I}{S^2} \leqq 0.30$$

wherein I is a maximum cross-sectional secondary moment max (Ix, Iy) (i.e., the maximum secondary moment in the cross-sectional secondary moments with respect to the main X axis and y axis passing through the center of the gravity of the cross-section); and, then, is subjected to multi-stage stretching under the conditions satisfying the following equations:

$$DR_{T1} \geqq 5$$

$$DR_{Ti} = \frac{V_{i+1}}{V_1} \leqq DR_{Tiw} \times (1.0 - 0.0970e^{-0.312 \times i})$$

$$\theta_i \leqq T_m - 37\ (i = 1)$$

$$T_m - 27 \leqq \theta_i \leqq T_m - 17\ (i \geqq 2)$$

wherein i is a number of stretching stages, e is a base of natural logarithm (i.e., 2.71828), $V_1$ is the first take-off linear velocity (m/min), $V_{i+1}$ is the final take-off linear velocity (m/min) at the i-stretching stage, $DR_{T1}$ is the stretching ratio at the first stretching stage, $DR_{Ti}$ is the total stretching ratio at the i-stretching stage, $DR_{Tiw}$ is the $DR_{Ti}$ from which the monofilament begins to become whitened at the i-stretching stage, $T_m$ is the melting point of the thermoplastic resin and $\theta_i$ is the temperature of the filament at the i-stretching stage.

22. A process as claimed in claim 21, wherein a neck stretching by which necking deformation occurs is effected during first-stage wet stretching and subsequent-stage dry stretching is effected by means of heated rolls after the completion of the necking deformation.

23. A process as claimed in claim 21, wherein polyethylene having a melt index of 0.1 through 0.9 g/10 min. and a ratio of a high-load melt index to a melt index of 40 or less is used.

24. A process as claimed in claim 21, wherein the extrusion of the monofilament is effected through a screw type extruder having a metering portion having a groove depth Hm of $0.157D^{0.719}$ through $0.269D^{0.719}$ mm, wherein D is a bore diameter (mm) of the extruder.

25. A process as claimed in claim 24, wherein polyethylene having a melt index of 0.1 through 0.9 g/10 min and a ratio of a high-load melt index to a melt index of 40 or less is melt extruded at a nozzle shear rate of 150 through 900 $sec^{-1}$ and the extruded monofilament is stretched.

26. A process as claimed in claim 25, wherein the first-stage neck stretching by which necking deformation occurs is effected at a deformation velocity of 50 $min^{-1}$ or less and subsequent-stage stretching is effected at a deformation velocity of 20 $min^{-1}$ or less $$\frac{V_{i+1} - V_i}{L_i}$$

wherein $L_i$ is an effective stretching distance (m) at the i-stage stretching, $V_i$ is a delivery linear velocity (m/min) of the filament at the i-stretching stage and $V_{i+1}$ is the final take-off linear velocity (m/min) of the filament at the i-stretching stage.

27. A process as claimed in claim 26, wherein the first-stage neck stretching is effected at a temperature of 100° C. or less and the subsequent-stage stretching after the completion of the neck stretching is effected at a temperature of 100° C. or more.

28. A process as claimed in claim 21, wherein the first stretching ratio $DR_{T1}$ is 10 or more.

29. A process as claimed in claim 21, wherein the denier of the finished monofilament is 300 or more.

30. A process as claimed in claim 22, wherein polyethylene having a melt index of 0.1 through 0.9 g/10 min. and a ratio of a high-load melt index to a melt index of 40 or less is used.

31. A process as claimed in claim 22, wherein the extrusion of the monofilament is effected through a screw type extruder having a metering portion having a groove depth Hm of $0.157D^{0.719}$ through $0.269D^{0.719}$ mm, wherein D is a bore diameter (mm) of the extruder.

32. A process as claimed in claim 31, wherein polyethylene having a melt index of 0.1 through 0.9 g/10 min and a ratio of a high-load melt index to a melt index of 40 or less is melt extruded at a nozzle shear rate of 150 through 900 $sec^{-1}$ and the extruded monofilament is stretched.

33. A process as claimed in claim 32, wherein the first-stage neck stretching by which necking deformation occurs is effected at a deformation velocity of 50 $min^{-1}$ or less and subsequent-stage stretching is effected at a deformation velocity of 20 $min^{-1}$ or less $$\frac{V_{i+1} - V_i}{L_i}$$

wherein $L_i$ is an effective stretching distance (m) at the i-stage stretching, $V_i$ is a delivery linear velocity (m/min) of the filament at the i-stretching stage and $V_{i+1}$ is the final take-off linear velocity (m/min) of the filament at the i-stretching stage.

34. A process as claimed in claim 33, wherein the first-stage neck stretching is effected at a temperature of 100° C. or less and the subsequent-stage stretching after the completion of the neck stretching is effected at a temperature of 100° C. or more.

35. A process as claimed in claim 34, wherein the first stretching ratio $DR_{T1}$ is 10 or more.

36. A process as claimed in claim 35, wherein the denier of the finished monofilament is 300 or more.

* * * * *